US009023127B2

(12) United States Patent
Fredriksson et al.

(10) Patent No.: US 9,023,127 B2
(45) Date of Patent: May 5, 2015

(54) METHOD, ARRANGEMENT, AND PELLETISING PLANT

(75) Inventors: Christian Fredriksson, Luleå (SE); Stefan Savonen, Svappavaara (SE)

(73) Assignee: Luossavaara-Kiirunavaara AB, Luleå (SE)

( * ) Notice: Subject to any disclaimer, the term of this patent is extended or adjusted under 35 U.S.C. 154(b) by 115 days.

(21) Appl. No.: 13/881,717

(22) PCT Filed: Oct. 26, 2011

(86) PCT No.: PCT/SE2011/051274
§ 371 (c)(1),
(2), (4) Date: Apr. 25, 2013

(87) PCT Pub. No.: WO2012/057686
PCT Pub. Date: May 3, 2012

(65) Prior Publication Data

US 2013/0205949 A1 Aug. 15, 2013

(30) Foreign Application Priority Data

Oct. 26, 2010 (SE) ..... 1051109-5

(51) Int. Cl.

| | |
|---|---|
| ***C22B 1/02*** | (2006.01) |
| ***F27B 9/36*** | (2006.01) |
| ***C22B 1/20*** | (2006.01) |
| ***C22B 1/212*** | (2006.01) |
| ***F27B 9/30*** | (2006.01) |
| ***F27B 21/00*** | (2006.01) |

(52) U.S. Cl.
CPC ... *C22B 1/02* (2013.01); *F27B 9/36* (2013.01); *C22B 1/205* (2013.01); *C22B 1/212* (2013.01); *F27B 9/3005* (2013.01); *F27B 21/00* (2013.01)

(58) Field of Classification Search
CPC ..... C22B 1/205; C22B 1/212; C22B 1/02; F27B 9/36; F27B 9/3005; F27B 21/00
USPC ..... 75/769; 266/171, 175, 176
See application file for complete search history.

(56) References Cited

U.S. PATENT DOCUMENTS

| | | | |
|---|---|---|---|
| 4,332,551 A | 6/1982 | Haslmayr et al. | |
| 4,367,065 A | 1/1983 | Cnare | |

FOREIGN PATENT DOCUMENTS

| | | | |
|---|---|---|---|
| EP | 79264 A | * | 5/1983 |
| GB | 2042144 A | | 9/1980 |
| JP | 56-142830 A | | 11/1981 |

OTHER PUBLICATIONS

Machine translation of EP 79264 A published on May 1983.*

(Continued)

*Primary Examiner* — George Wyszomierski
*Assistant Examiner* — Tima M McGuthry Banks
(74) *Attorney, Agent, or Firm* — Morrison & Foerster LLP

(57) ABSTRACT

A method during the oxidation and sintering of pellets includes the introduction of a first medium into the compartment through an inlet connected to the compartment and the heating of the first medium in the inlet through the use of a combustion arrangement. The use of the combustion arrangement includes the ignition of the fuel, combustion of the fuel, and the transfer of the combustion heat to the first medium that is present at the combustion arrangement. A second medium is introduced to the inlet through an intake in the direct vicinity of the combustion arrangement, where the ignition of the fuel and the combustion of the fuel take place for the transfer of combustion heat also to the second medium. The heated first medium and the heated second medium are mixed before or during their introduction into the compartment.

15 Claims, 3 Drawing Sheets

(56) References Cited

OTHER PUBLICATIONS

International Search Report and Written Opinion received for PCT Patent Application No. PCT/SE2011/051274, mailed on Feb. 21, 2012, 8 pages.

International Preliminary Report on Patentability received for PCT Patent Application No. PCT/SE2011/051274, mailed on May 10, 2013, 6 pages.

* cited by examiner

METHOD, ARRANGEMENT, AND PELLETISING PLANT

CROSS REFERENCE TO RELATED APPLICATIONS

This is a U.S. National Phase patent application of PCT/SE2011/051274, filed Oct. 26, 2011, which claims priority to Swedish Patent Application No. 1051109-5, filed Oct. 26, 2010, each of which is hereby incorporated by reference in the present disclosure in its entirety.

TECHNICAL AREA

This invention concerns a method and an arrangement for obtaining a low NOx level during the oxidation and sintering of pellets. The invention concerns also a pelletising plant.

BACKGROUND

The mixing of iron ore concentrate, finely divided iron ore in powder form, from which undesired components of the ore have been removed, with water in a preparation plant in order subsequently to be processed in a pelletising plant is known.

The ore concentrate is dewatered in the pelletising plant and mixed with various additives and binding agents, and rolled to pellets. The pellets are dried in a drying arrangement and heated in a compartment such that the balls are oxidised, sintered and caused to melt together, one with another, to form final pellets of ore, which maintain their shape during further transport. A cooling of the pellets subsequently takes pace in a cooling arrangement. The pellets are now ready and can be transported onwards to the locations at which the ore is to be further refined.

The use of an arrangement comprising an inlet connected to the compartment for introduction of a medium through the inlet and into the compartment is previously known. A combustion arrangement for heating the medium is arranged in the inlet. The combustion arrangement comprises fuel that, when the arrangement is in use, is ignited and combusted. Combustion heat is developed during the combustion, which heat is transferred to the medium that is present at the combustion arrangement in the inlet and that passes through the inlet on its way to the compartment.

The heating, the oxidation and the sintering of the pellets cause magnetite to be converted to haematite, with NOx as a waste product in the medium. NOx becomes present in the medium, which has, after the sintering, completed its task and is to be replaced by new, hot medium. NOx is harmful to the environment and it is therefore desirable that the sintering give rise to as little NOx as possible.

DESCRIPTION OF THE INVENTION

One purpose of this invention is to offer a method, an arrangement and a pelletising plant for obtaining a low NOx level during the oxidation and sintering of pellets arranged in a compartment, with the aid of a medium having high temperature.

This is obtained with the technical features that are described below.

DETAILED DESCRIPTION OF EMBODIMENTS

Figure 1:
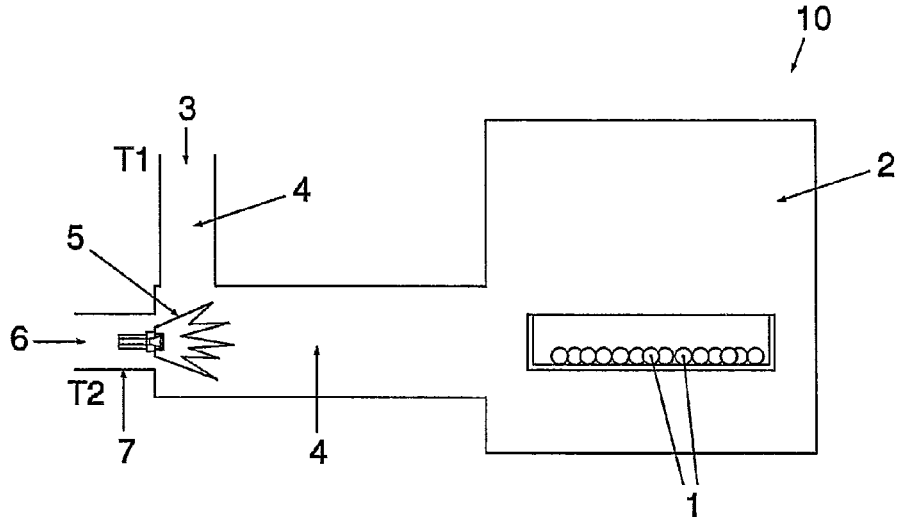
FIG. 1 shows an arrangement according to the invention.

A method and an arrangement according to this invention that will be described below will have the same function and intention independently of whether it is a pelletising plant with iron pellets of whether it is a more general sintering plant in which ore concentrate is not formed into pellets but where the ore concentrate is oxidised and sintered without first being formed. The term "pelletising plant" in the description below is to be interpreted in its widest sense, which means that also a sintering plant is described by the term. The term "pellets" is also to be interpreted in its widest sense, such that also iron ore concentrate in random aggregates in a sintering plant is described by the term "pellets".

This invention concerns a method for obtaining a low NOx level during the oxidation and sintering of pellets 1 arranged in a compartment 2 in which the oxidation and sintering take place with the aid of a medium with a defined temperature, which medium heats the pellets 1.

The method comprises the introduction of a first medium 3 into the compartment 2 through an inlet 4 connected to the compartment 2 and the heating of the first medium 3 when it is present in the inlet 4. The heating takes place through the use of a combustion arrangement 5, or a part of such an arrangement, that is arranged in the inlet 4. The combustion arrangement 5 comprises fuel, which is not shown in the drawings.

The use of the combustion arrangement 5 comprises the ignition of the fuel and the continued, principally continuous, combustion of fuel, whereby combustion heat is developed. The combustion heat is transferred to the first medium 3 that is present at the combustion arrangement 5 in the inlet 4, whereby the first medium 3 is heated.

The method comprises also the introduction of a second medium 6 into the inlet 4. The second medium is introduced into the inlet 4 through an intake 7. The intake 7 is located in the direct vicinity of the combustion arrangement 5 where the ignition of the fuel and the combustion of the fuel take place. The combustion heat is transferred also to the second medium 6, which is present at the combustion arrangement 5 in the inlet 4. Mixing of the heated first medium 3 and the heated second medium 6 takes place before or at the introduction of the two media 3 and 6 into the compartment 2, which mixing is subsequently followed by the use of the heated media 3 and 6 for the oxidisation and sintering of the pellets 1 that are present in the compartment 2. See FIG. 1.

The introduction of the two media 3 and 6, the first medium 3 and the second medium 6, or a mixture of these two, into the compartment 2 that is used for the oxidation and sintering of the pellets 1 makes it possible to optimise the oxidation and the sintering of the pellets 1 and obtain a low NOx level at the same time.

Figure 2:
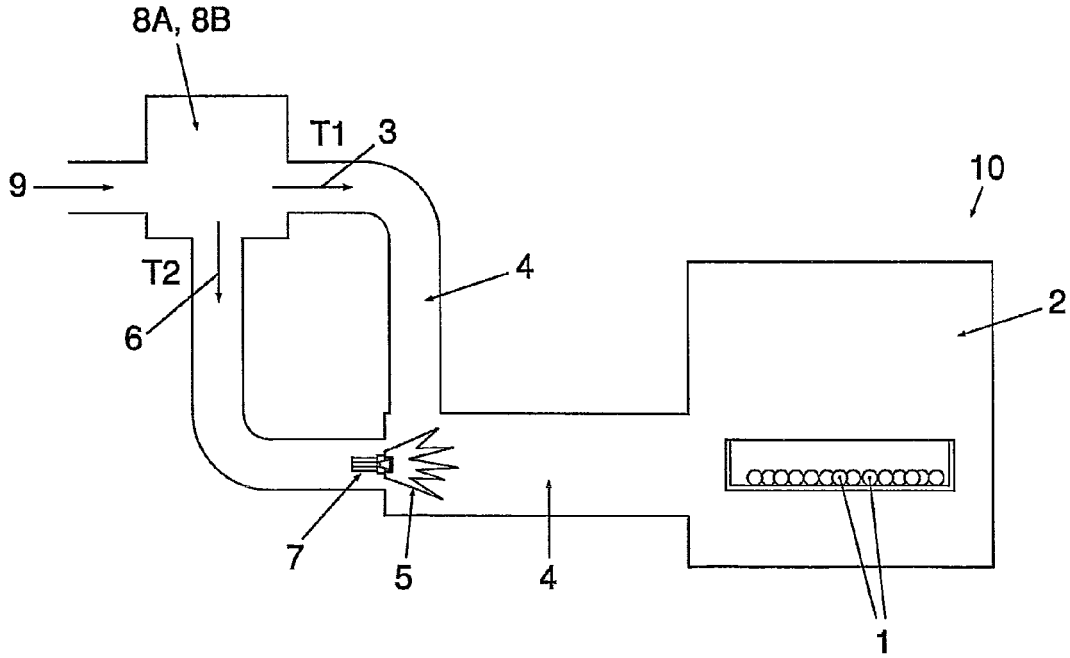
FIG. 2 shows a second embodiment of an arrangement according to the invention.

The method comprises preheating of the first medium 3 in a preheating arrangement 8A before it is introduced into the inlet 4 and the preheating of the second medium 6 before it is introduced in the vicinity of the combustion arrangement 5 in the inlet 4. The media 3 and 6 are further heated in the inlet 4 in a previously described manner, in order subsequently to oxidise and sinter the pellets 1 that are present in the compartment 2. The preheating of the media 3 and 6 makes it possible to reduce the energy consumption when heating the media 3 and 6 with the aid of the combustion arrangement 5, immediately before the transport of the media 3 and 6 into the compartment 2 that is then used for the oxidation and sintering of the pellets 1. See FIG. 2.

The first medium 3 and the second medium 6 are preheated to different temperatures T1 and T2. This gives an increased possibility of further reducing the energy consumption and minimizing the NOx level, by maximizing the reduction of NOx. The first medium 3 is preheated to a temperature T1 that is higher than the temperature T2 of the second medium, before or at the introduction into the inlet 4. The first medium 3 is preheated to a temperature T1 in the interval 500-1500° C.

Figure 3:
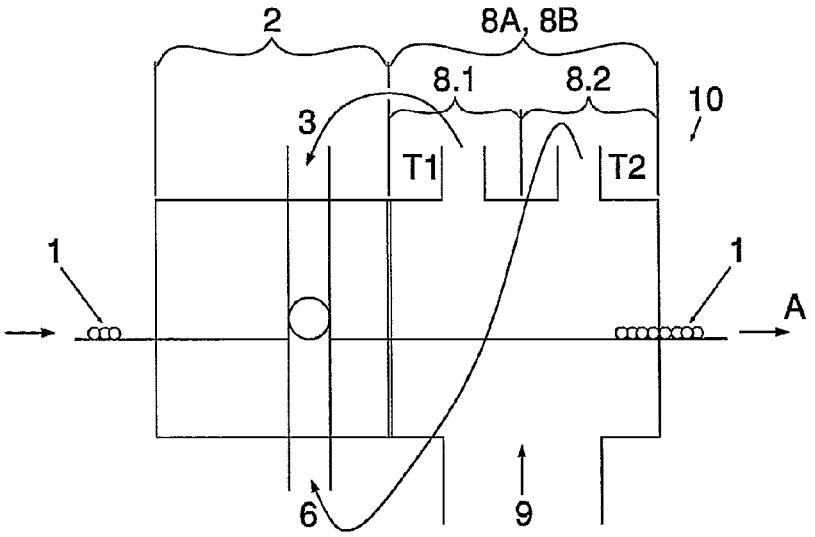
FIG. 3 shows a further embodiment of an arrangement according to the invention.

During the sintering of pellets in a pelletising plant, a cooling arrangement 8B is used, into which is supplied a cooling agent 9 for the cooling of the heated and sintered pellets 1, after the oxidation and the sintering, after the pellets 1 have been present in the compartment 2. This cooling agent 9 is thus heated by the hot pellets 1. See FIG. 3.

According to this invention, this cooling agent 9, which has been heated by the hot pellets 1, is used as the preheated first medium 3 and the preheated second medium 6 that are to be introduced into the inlet 4 for further heating and subsequently onwards into the compartment 2.

Thus, it is a question of a functional energy recycling in the process, since the heat from the pellets 1, which have been heated during the oxidation and sintering, is recycled to the sintering such that the heat energy that is absorbed by the cooling agent 9 in the cooling arrangement 8B is used during a preheated heating stage for the media 3 and 6 that are supplied to the sintering process. Thus the cooling agent 9 will be used as at least one of the first medium 3 and the second medium 6, which is, in turn, be used to heat the compartment 2 and the pellets 1 in the compartment 2, and which thus is preheated before its introduction into the inlet 4.

The cooling agent 9 is used as a heating agent, after it has been heated in the cooling arrangement 8. The cooling arrangement 8B will thereby be functioning also as the preheating arrangement 8A. The same arrangement is a cooling arrangement 8B to cool the oxidised and sintered pellets 1, and is a preheating arrangement 8A in order to preheat the media 3 and 6 that are to heat the pellets 1 during the oxidation and sintering. The reference numbers 8A and 8B refer thus to the same arrangement, but have been given different reference numbers depending on the function that is being referred to.

The cooling agent 9 that is supplied to the hot, sintered pellets 1 in the cooling arrangement 8B in order to cool them is divided into the preheated first medium 3 and the preheated second medium 6 after the cooling agent 9 has been used for the cooling of the hot, sintered pellets 1 and thus heated. See FIG. 3.

Figure 4:
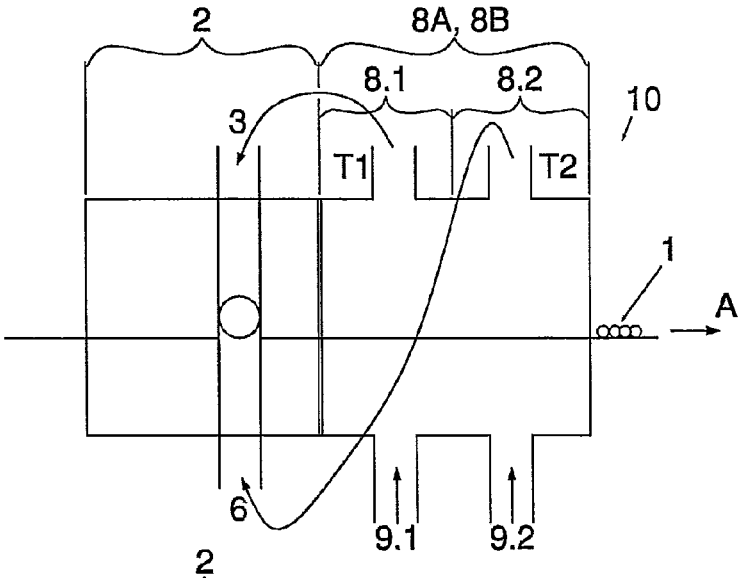
FIG. 4 shows a further embodiment of an arrangement according to the invention.

It is possible also to use two separate cooling agents 9.1 and 9.2, each one of which is caused to pass the pellets 1 after the oxidation and sintering, and that have been heated after the cooling of the pellets 1, and constitutes the preheated first medium 3 and the preheated second medium 6. See FIG. 4.

Figure 5:
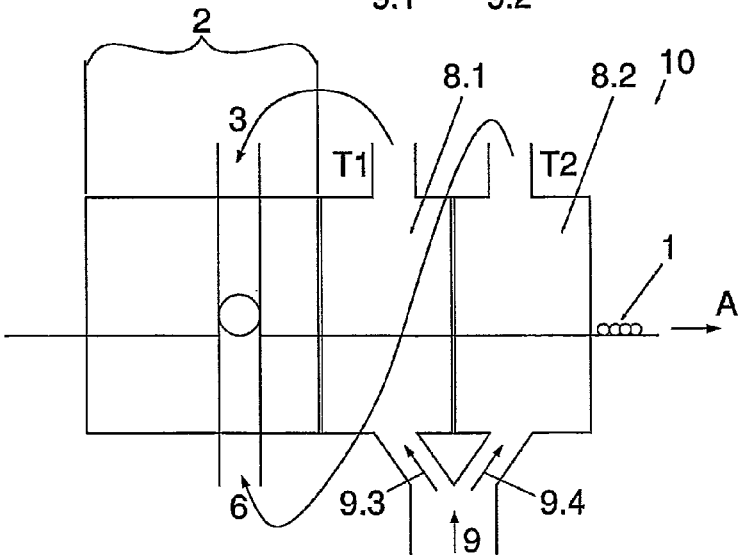
FIG. 5 shows a further embodiment of an arrangement according to the invention.
Figure 6:
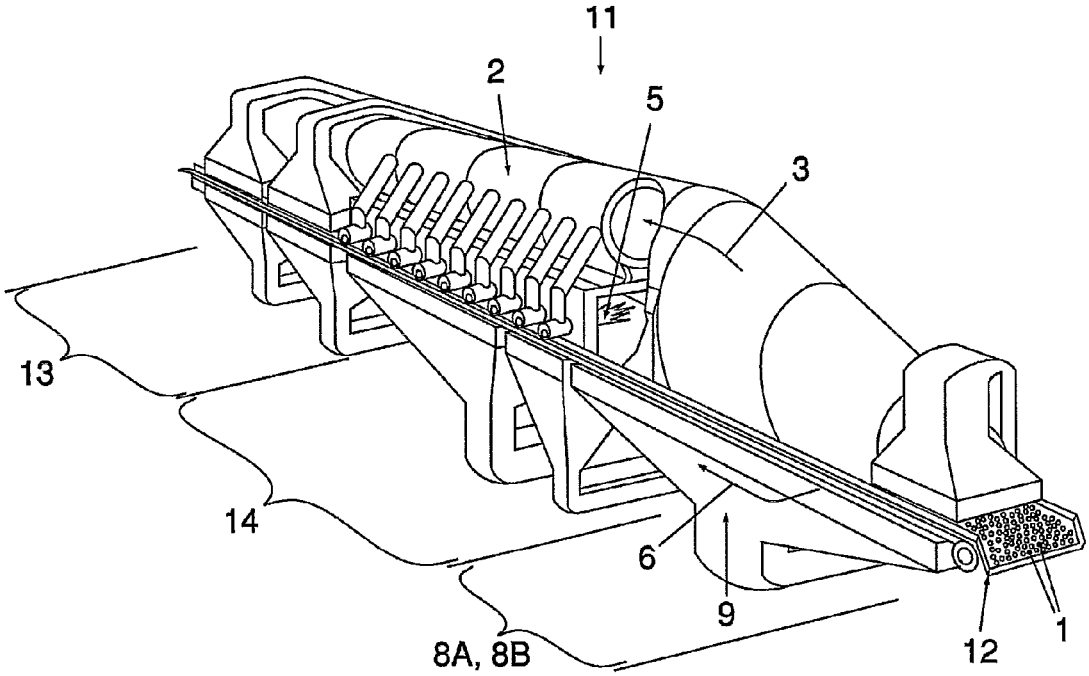
FIG. 6 shows a pelletising plant according to the invention.

A further possibility is the use of a cooling agent 9 and the division of the cooling agent into a first cooling agent fraction 9.3 and a second cooling agent fraction 9.4 before the cooling of the hot, sintered pellets 1, where the first cooling agent fraction 9.3 and the second cooling agent fraction 9.4 are used, after the cooling of the hot, oxidised and sintered pellets 1, as the preheated first medium 3 and the preheated second medium 6. See FIG. 5.

The method comprises further the heating of the cooling agent 9, the cooling agents 9.1 and 9.2, the cooling agent fractions 9.3 and 9.4, with the aid of the hot pellets 1 to two different temperatures T1 and T2, which results in a preheated first medium 3 and a preheated second medium 6 with different temperatures T1 and T2.

The pellets 1 that are to be cooled after the oxidation and sintering pass out from the compartment 2 and onwards into a cooling arrangement 8B that constitutes at the same time the preheating arrangement 8A for the first medium 3 and the second medium 4. The cooling arrangement 8B comprises at least two different zones 8.1 and 8.2 where the pellets in the different zones 8.1 and 8.2 have different temperatures T1 and T2. The zones 8.1 and 8.2 may constitute two end parts of a single limited region, or compartment, that the pellets 1 pass through after the oxidation and sintering, from one end part to the second end part, see FIGS. 3 and 4. The zones 8.1 and 8.2 may be two separate regions, or compartments, arranged one after the other in the direction A of displacement of the pellets, see FIG. 5.

A cooling agent 9 may be introduced into the relevant zone 8.1 or 8.2, or two cooling agents 9.1 and 9.2, or two cooling agent fractions 9.3 and 9.4, may be used and supplied individually to the relevant zone 8.1 or 8.2. The heated cooling agent 9, the cooling agents 9.1 and 9.2, the cooling agent fractions 9.3 and 9.4 are subsequently removed from the relevant zone 8.1 or 8.2, which results in two different preheated media 3 and 6 with different temperatures T1 and T2, in the case in which the cooling agent 9 was a single agent or in the case in which the cooling agents 9.1 and 9.2, cooling agent fractions 9.3 and 9.4, had essentially the same temperature when they were introduced into the cooling arrangement 8. See FIGS. 3-5.

That which is referred to as "zones" 8.1 and 8.2 is two different regions through which the pellets 1 are caused to pass. The pellets 1 have different temperatures in each zone 8.1 and 8.2. A first zone 8.1 is passed through immediately after the pellets 1 have left the compartment 2. The pellets 1 have their highest temperature in this zone 8.1. The pellets 1 are cooled in this first zone 8.1 through them being passed by the cooling agent 9, the first cooling agent 9.1 or the first cooling agent fraction 9.3. The pellets 1, which now have been somewhat cooled, subsequently pass out from the first zone 8.1 and onwards into at least one second zone 8.2 in which the pellets 1 are further cooled by the cooling agent 9, a second cooling agent 9.2, a second cooling agent fraction 9.4. Further zones may follow these first two zones, or only two zones may be used. The pellets 1 are most deeply cooled after the final zone 8.2, and thus have the lowest temperature.

This method results in the heating of the cooling agent 9, the cooling agents 9.1 and 9.2, the fractions 9.3 and 9.4 of cooling agent, to different temperatures, and thus the provision of a first medium 3 and a second medium 6 with the different temperatures T1 and T2. The cooling agent 9, 9.1 or 9.3 that passes the pellets 1 in the first cooling zone 8.1 is heated most, and the cooling agent 9, 9.2 or 9.4 that passes the pellets 1 in the final cooling zone 8.2 is heated least.

It is most appropriate to use air as medium, both as the first medium 3 and the second medium 6. It is appropriate to use air also as the cooling agent 9. Other media, than air, may be considered without further precise details being specified.

The invention concerns also an arrangement 10 for obtaining a low NOx level during the sintering of pellets 1 comprising a compartment 2 in which the pellets are arranged to, through which the pellets 1 are caused to pass, and in which a medium with a defined, high, temperature is introduced in order to transfer heat to the pellets 1. This arrangement 10 makes it possible to carry out the method according to the invention that has been described.

The arrangement 10 comprises an inlet 4 that is connected, during the use of the arrangement 10, with the compartment 2 in which the pellets 1 are oxidised and sintered with the aid of the hot medium. The inlet 4 is used for the introduction of a first medium 3 into the compartment 2 and the first medium 3 is heated in the inlet 4. The arrangement 10 comprises further a combustion arrangement 5, or part of a combustion arrangement, that is arranged in the inlet 4 for heating of the first medium 3 when it is present in the inlet 4. The combustion arrangement 5 comprises fuel that, during the use of the arrangement, is ignited and combusted whereby combustion heat is developed and transferred to the first medium 3 that is located at the combustion arrangement 5.

The arrangement 10 comprises also an intake 7 arranged in connection with the inlet 4 for the introduction of a second medium 6 in the direct vicinity of the combustion arrangement 5, the combustion arrangement part, where the ignition of the fuel and its combustion take place, and also where combustion heat is transferred to the second medium 6. The inlet 4 makes possible the mixing of the heated first medium 3 and the heated second medium 6 before or at their introduction into the compartment 2.

An arrangement 10 according to this invention that makes possible the introduction of two media 3 and 6, the first medium 3 and the second medium 6, or a mixture of the two media 3 and 6, into a compartment 2 that is used for the oxidation and sintering of pellets 1 provides the opportunity to optimise the oxidation and the sintering, and obtain a low NOx level at the same time.

The combustion arrangement 5 comprises a component that in turn comprises a nozzle through which the fuel in the combustion arrangement is fed out, and an ignition arrangement that ignites the fuel and where the component constitutes that part of the combustion arrangement 5 that is arranged in the compartment 2. Such combustion arrangements are previously known and are therefore not shown in detail in the drawings.

The arrangement 10 comprises also at least one preheating arrangement 8A that preheats the first medium 3 before it is introduced into the inlet 4 and that preheats the second medium 6 before it is introduced into the inlet 4.

The preheating arrangement 8A preheats the first medium 3 and the second medium 6 to different temperatures T1 and T2. The preheating arrangement 8A preheats the first medium 3 to a temperature that is higher than that of the second medium 6. The preheating arrangement 8A preheats the first medium to a temperature in the interval 500-1500° C.

The preheating arrangement 8A constitutes a cooling arrangement 8B comprising at least two zones 8.1 and 8.2 through which sintered pellets 1 pass and where the cooling zones 8.1 and 8.2 are supplied with a cooling agent 9 for the cooling of the pellets 1. At the same time as the pellets 1 are cooled, the cooling agent 9 is heated by the pellets 1 and absorbs heat energy, and the cooling agent is subsequently used as the preheated first medium 3 and the preheated second medium 6.

The pellets 1 that are to be cooled after the oxidation and sintering pass out from the compartment 2 and onwards into the cooling arrangement 8B that constitutes at the same time the preheating arrangement 8A for the first medium 3 and the second medium 6.

The preheating arrangement 8A comprises at least one zone 8.1 or 8.2 through which sintered pellets 1 pass and where the zone is supplied with a cooling agent 9 for the cooling of the pellets 1 and where the cooling agent 9 is thereby heated by the pellets 1 in order subsequently to be used as the preheated first medium 3 and the preheated second medium 6.

It is appropriate that the preheating arrangement 8A comprise at least two zones 8.1 and 8.2 where each one of the zones is supplied with a cooling agent 9 for the cooling of the pellets 1 in the relevant zone 8.1 and 8.2 and where the cooling agent thereby is heated by the pellets 1 in the relevant zone 8.1 and 8.2 in order subsequently to be used as the preheated first medium 3 and the preheated second medium 6.

It is appropriate that the preheating arrangement comprise at least two different zones 8.1 and 8.2 where the pellets 1 in the relevant zones 8.1 and 8.2 have different temperatures T1 and T2. The zones 8.1 and 8.2 may constitute two end parts of a single limited region, compartment, that the pellets 1 pass through after the oxidation and sintering, from one end part to the second end part, see FIGS. 3 and 4, or the zones 8.1 and 8.2 may be two separate regions, compartments, arranged one after the other in the direction of displacement of the pellets, see FIG. 5.

The arrangement 10, the preheating arrangement 8A, comprises two zones 8.1 and 8.2 that are arranged one after the other and where the pellets 1 in the first zone 8.1 are hotter than the pellets 1 in the second zone 8.2 and where each one of the zones 8.1 and 8.2 is supplied with a cooling agent 9 for the cooling of the pellets and where the cooling agent 9 is heated by the pellets 1 to two different temperatures T1 and T2 in order subsequently to be used as the preheated first medium 3 and the preheated second medium 6 and introduced into the compartment 2 in order to sinter the pellets 1 that are present in the compartment 2.

The first zone 8.1 gives as a result that the first medium 3, which has a higher temperature T1 than the second medium 6 since the pellets 1 that pass the first zone 8.1 come directly from the sintering, from the compartment 2, and are thus hotter, heats the first medium 3 to a higher temperature T1 than the temperature to which the second zone 8.2 heats the second medium 6 since the pellets 1 in this zone 8.2 have already been cooled in the first zone 8.1.

The invention concerns also a pelletising plant 11 comprising an arrangement 10 that is in agreement with the arrangement that has been described above. This pelletising plant 11 makes it possible to carry out the method according to the invention that has been described and it makes possible a low NOx level during the oxidation and sintering of pellets 1.

Such a pelletising plant 11 is of the "straight grate plant" type comprising a belt transporter 12 on which pellets 1 are transported through the complete pelletising plant 11, a drying arrangement 13 in which the pellets 1 are dried and may optionally be preheated, a sintering part 14 that comprises the compartment 2 and where a number of process-controlling arrangements are arranged along and on each side of the sintering part 14, and a preheating arrangement 8A/cooling arrangement 8B that follows this sintering part.

This description of different embodiments of the invention and alternative designs of its items and methods is not to be seen as a limitation of the invention: it is to be interpreted in its broadest meaning in order not to limit unnecessarily the protective scope according to the attached patent claims. Changes that lie within the expertise of a person skilled in the arts lie within the protective scope of the innovative concept. The various designs of items that are given in the description above can be used and combined freely, as long as the desired function is obtained.

The invention claimed is:

1. A method for oxidation and sintering of pellets arranged in a compartment in which sintering takes place with a medium with a high temperature, which medium heats the pellets, the method comprising:

introducing a first medium into the compartment through an inlet connected to the compartment;

heating the first medium in the inlet through use of a combustion arrangement or a part thereof arranged in the inlet, wherein the combustion arrangement or a part thereof comprises fuel where the use of the combustion arrangement or a part thereof comprises an ignition of the fuel, a combustion of the fuel whereby combustion heat is developed, and a transfer of the combustion heat to the first medium that is present at the combustion arrangement or a part thereof;

introducing a second medium into the inlet through an intake in a direct vicinity of the combustion arrangement or a part thereof where the ignition of the fuel and the combustion of the fuel take place for the transfer of combustion heat also to the second medium that is present at the combustion arrangement or a part thereof, and the mixing of the heated first medium and the heated second medium before or during their introduction into the compartment; and preheating the first medium before it is introduced into the inlet and preheating the second medium before it is introduced in the vicinity of the combustion arrangement or a part thereof in the inlet, wherein the first medium and the second medium are preheated to different temperatures.

2. The method according to claim 1, comprising preheating of the first medium to a temperature that is higher than the temperature of the second medium.

3. The method according to claim 1, comprising preheating of the first medium to a temperature in the interval 500-1500° C.

4. The method according to claim 1, comprising the use of air as medium.

5. A method for oxidation and sintering of pellets arranged in a compartment in which sintering takes place with a medium with a high temperature, which medium heats the pellets, the method comprising:

introducing a first medium into the compartment through an inlet connected to the compartment;

heating the first medium in the inlet through use of a combustion arrangement or a part thereof arranged in the inlet, wherein the combustion arrangement or a part thereof comprises fuel where the use of the combustion arrangement or a part thereof comprises an ignition of the fuel, a combustion of the fuel whereby combustion heat is developed, and a transfer of the combustion heat to the first medium that is present at the combustion arrangement or a part thereof;

introducing a second medium into the inlet through an intake in a direct vicinity of the combustion arrangement or a part thereof where the ignition of the fuel and the combustion of the fuel take place for the transfer of combustion heat also to the second medium that is present at the combustion arrangement or a part thereof, and the mixing of the heated first medium and the heated second medium before or during their introduction into the compartment;

using two cooling agents for cooling heated sintered pellets after oxidation and sintering, followed by using two heated cooling agents as a preheated first medium and a preheated second medium.

6. A method for oxidation and sintering of pellets arranged in a compartment in which sintering takes place with a medium with a high temperature, which medium heats the pellets, the method comprising:

introducing a first medium into the compartment through an inlet connected to the compartment;

heating the first medium in the inlet through use of a combustion arrangement or a part thereof arranged in the inlet, wherein the combustion arrangement or a part thereof comprises fuel where the use of the combustion arrangement or a part thereof comprises an ignition of the fuel, a combustion of the fuel whereby combustion heat is developed, and a transfer of the combustion heat to the first medium that is present at the combustion arrangement or a part thereof;

introducing a second medium into the inlet through an intake in a direct vicinity of the combustion arrangement or a part thereof where the ignition of the fuel and the combustion of the fuel take place for the transfer of combustion heat also to the second medium that is present at the combustion arrangement or a part thereof, and the mixing of the heated first medium and the heated second medium before or during their introduction into the compartment;

using a cooling agent for cooling heated sintered pellets after oxidation and sintering; and dividing the cooling agent into a first cooling agent fraction and a second cooling agent fraction before cooling the heated sintered pellets, where the first cooling agent fraction and the second cooling agent fraction, after cooling of the pellets, are used as a preheated first medium and a second medium.

7. The method according to claim 6, comprising the heating of the cooling agent, the cooling agents, the cooling agent fractions to two different temperatures, which results in a preheated first medium and a preheated second medium with different temperatures.

8. The method according to claim 7, comprising the use of the cooling agent, the cooling agents, the cooling agent fractions for the cooling of pellets that are located in at least two different zones where the pellets in the relevant zone have different temperatures, which results in a heating of the cooling agent, the cooling agents, the cooling agent fractions to different temperatures and thereby acquiring different temperatures by the preheated first medium and the preheated second medium.

9. An arrangement for oxidation and sintering of pellets, the arrangement comprising:

a compartment in which the pellets are arranged and in which a first medium with a determined temperature is introduced for a transfer of heat to the pellets;

an inlet connected to the compartment for an introduction of the first medium through the inlet and into the compartment and where heating of the first medium takes place, and a combustion arrangement or a part thereof arranged in the inlet for heating of the first medium when it is present in the inlet wherein the combustion arrangement or a part thereof comprises fuel that, during the use of the arrangement, is ignited and combusted whereby combustion heat is developed and transferred to the first medium that is located at the combustion arrangement or a part thereof;

an intake arranged in connection with the inlet for the introduction of a second medium in a direct vicinity of the combustion arrangement or a part thereof where the ignition of the fuel and its combustion take place, and also where combustion heat is transferred to the second medium and that the inlet makes possible the mixing of the heated first medium and the heated second medium before or at their introduction into the compartment;

a preheating arrangement that preheats the first medium before it is introduced into the inlet and that preheats the second medium before it is introduced into the inlet;

wherein the preheating arrangement comprises at least two zones, through which the sintered pellets pass, and where each one of the zones is supplied with a cooling agent for the cooling of the pellets in a corresponding zone and where the cooling agent is thereby heated by the pellets in the corresponding zone so as to be used as a preheated first medium and a preheated second medium the zones are arranged one after another, and the pellets in a first zone are hotter than the pellets in a second zone, and the cooling agent is heated by the pellets to two different temperatures.

10. The arrangement according to claim 9, where the first zone is arranged immediately after the compartment.

11. A pelletizing plant comprising an arrangement according to claim 9.

12. The pelletizing plant according to claim 11 of a straight grate plant, comprising:

a belt transporter on which the pellets are transported through the pelletizing plant;

a drying arrangement where the pellets are dried and may optionally be preheated;

an oxidation and sintering part that comprises the compartment; and a subsequent preheating arrangement/cooling arrangement.

13. An arrangement, for oxidation and sintering of pellets, the arrangement comprising:

a compartment in which the pellets are arranged and in which a first medium with a determined temperature is introduced for a transfer of heat to the pellets;

an inlet connected to the compartment for an introduction of the first medium through the inlet and into the compartment and where heating of the first medium takes place, and a combustion arrangement or a part thereof arranged in the inlet for heating of the first medium when it is present in the inlet wherein the combustion arrangement or a part thereof comprises fuel that, during the use of the arrangement, is ignited and combusted whereby combustion heat is developed and transferred to the first medium that is located at the combustion arrangement or a part thereof;

an intake arranged in connection with the inlet for the introduction of a second medium in a direct vicinity of the combustion arrangement or a part thereof where the ignition of the fuel and its combustion take place, and also where combustion heat is transferred to the second medium and that the inlet makes possible the mixing of the heated first medium and the heated second medium before or at their introduction into the compartment; and a preheating arrangement that preheats the first medium before it is introduced into the inlet and that preheats the second medium before it is introduced into the inlet, wherein the preheating arrangement preheats the first medium and the second medium to different temperatures.

14. The arrangement according to claim 13, where the preheating arrangement preheats the first medium to a higher temperature than that of the second medium.

15. The arrangement according to claim 13, where the preheating arrangement preheats the first medium to a temperature in the interval 500-1500° C.

* * * * *